US005664296A

United States Patent [19]

May

[11] Patent Number: 5,664,296

[45] Date of Patent: Sep. 9, 1997

[54] CLOSURE ARRANGEMENT HAVING A RECLOSABLE SEAL

[75] Inventor: Timothy J. May, Greenville, Wis.

[73] Assignee: Reynolds Consumer Products Inc., Appleton, Wis.

[21] Appl. No.: 669,743

[22] Filed: Jun. 26, 1996

[51] Int. Cl.[6] ..... B65D 33/00

[52] U.S. Cl. ..... 24/30.5 R; 24/587; 383/63

[58] Field of Search ..... 24/30.5 R, 30.5 P, 24/587, 576, 400; 383/5, 63

[56] References Cited

U.S. PATENT DOCUMENTS

| | | | |
|---|---|---|---|
| 2,746,502 | 5/1956 | Graell | 150/3 |
| 2,789,609 | 4/1957 | Post | 150/3 |
| 2,978,769 | 4/1961 | Harrah | 24/201 |
| 4,736,451 | 4/1988 | Ausnit | 24/587 |
| 4,787,755 | 11/1988 | Branson | 383/65 |
| 4,796,300 | 1/1989 | Branson | 383/63 |
| 4,925,318 | 5/1990 | Sorenson | 383/63 |
| 4,944,072 | 7/1990 | Robson | 24/587 |
| 4,947,525 | 8/1990 | Van Erden | 24/304 |
| 4,964,739 | 10/1990 | Branson et al. | 383/63 |
| 4,969,967 | 11/1990 | Sorenson et al. | 156/66 |
| 5,189,765 | 3/1993 | Singhal | 24/400 |
| 5,336,294 | 8/1994 | Wirth et al. | 383/61 |
| 5,474,382 | 12/1995 | May | 383/211 |
| 5,520,463 | 5/1996 | Tilman | 24/587 |
| 5,558,439 | 9/1996 | Tilman | 24/587 |

FOREIGN PATENT DOCUMENTS

| | | | |
|---|---|---|---|
| 0484599 | 5/1992 | European Pat. Off. | 383/63 |
| 1153027 | 2/1958 | France | 24/587 |
| 0551216 | 6/1958 | Italy | 383/63 |

*Primary Examiner*—Victor N. Sakran
*Attorney, Agent, or Firm*—Alan T. McDonald

[57] ABSTRACT

A closure arrangement includes a reclosable profile with a female profile and a male profile. The male profile has a rounded outer surface and includes a portion for attaching to the polymeric bag. The female profile includes a base also having a portion for attaching to the polymeric bag, and also has a locking member having opposite surfaces constructed and arranged to engage by friction and removably secure the male profile about its rounded outer surface. The female profile may include a break-away portion, or anti-seal portions.

20 Claims, 3 Drawing Sheets

CLOSURE ARRANGEMENT HAVING A RECLOSABLE SEAL

FIELD OF THE INVENTION

The present invention relates generally to closure arrangements for polymeric (plastic) bags. More particularly, the invention relates to closure arrangements providing a consistent seal and which allows for convenient access to the contents of the bag.

BACKGROUND OF THE INVENTION

Many consumer packaging applications employ reclosable bags. These bags employ reclosable zippers for locking products within the bags. A typical reclosable zipper includes male and female closures extending along the entire length of the zipper. The male closure typically may be tree-shaped, with an expanded head portion supported by a narrower trunk portion. The female closure is disposed opposite to the male closure and is adapted to mate with the male closure by members having locking edges or cornered shoulders. The closures are interlocked by properly aligning the male and female closures and pressing the closures together along the entire length of the zipper. The opposed members of the female closures slide over the expanded head portion of the male, and lock to it by hooking the head with the cornered shoulders and resting in the trunk portion.

In some applications, it is preferable to increase the "holding" or "lock" strength of the reclosable zipper to ensure that the zipper will not accidentally reopen, releasing the contents of the bag, and to also ensure an airtight seal between the inside of the bag and the outside of the bag. To increase lock strength, existing reclosable zippers employ stiffer materials or different configurations for designing the locking members of the zipper closure. Stiffer materials increase lock strength because such materials do not "give" as easily as more flexible materials, thereby making it more difficult to disengage interlocked locking members.

In order to increase the sealing properties between the male and female closures, it is sometimes advantageous to increase the surface area of the male and female closure which come in contact with one another. This increase creates a wider more resilient seal. Some of the prior art closure arrangements include male and female profiles with sharp angles or turns. In those cases, the surface area is reduced, and the sealing properties are not optimal.

In many consumer packaging applications, it is important to prevent air or water or the like from passing out of or into a package containing certain products. This is particularly true with respect to meat packages, cheese packages, and the like, for which the contained product is kept in a constant environment to prevent spoilage. In order to preserve the product contained within such a package, the periphery of the package is hermetically sealed. Hermetic seals can be provided by both permanent seals and temporary seals known as break-away seals. Break-away seals are capable of providing a hermetic seal and, at the same time, provide a consumer with access to the contents of a package. A break-away seal provides an indication of whether the package has been previously opened. Once the seal is broken by a consumer to initially gain access to the contents of the package, it cannot be restored.

To provide a break-away seal on a package with a reclosable zipper, the package typically uses permanent seals at its side edges and bottom edge and a break-away seal at the mouth end of the bag. Traditionally, the break-away seal at the mouth end of the bag has been positioned either adjacent to the reclosable zipper at the mouth end of the package or in gaps between the male and female locking members of the reclosable zipper.

When arranged adjacent to the reclosable zipper, the break-away seal may be positioned either above or below the reclosable zipper on the flange/skirt thereof. Positioning the break-away seal on the skirt of the zipper is disadvantageous because the skirt must be wide enough to accommodate the break-away seal. Such a wide skirt increases the amount of polymeric material required to form the zipper and, therefore, increases the cost of producing the zipper. Also, the increased amount of polymeric material can result in a higher incidence of leaks at the edge of the zipper, because an increased mass of polymeric material must be cut through, which can distort the zipper cross section upon cutting.

In an effort to overcome the above-noted shortcomings associated with positioning the break-away seal on the skirt of the zipper, it has been taught to arrange the break-away seal in gaps between male and female locking members of the reclosable zipper. When arranged in gaps between male and female locking members of the reclosable zipper, the break-away seal may be located, for example, between a T-shaped head of a male locking member and a base of a groove formed by two female locking members. One disadvantage of such a break-away seal is that it allows contaminants to travel up to the point of the break-away seal, which means that the locking members themselves can be contaminated prior to opening the bag.

Consequently, a need exists for a closure arrangement for a polymeric bag which overcomes the aforementioned shortcomings associated with existing closure arrangements.

SUMMARY OF THE INVENTION

The present invention includes a closure arrangement having a reclosable profile with a female profile and a male profile. The male profile has a rounded outer surface and includes a portion for attaching to the polymeric bag. The female profile includes a base also having a portion for attaching to the polymeric bag, and also has a locking member having opposite surfaces constructed and arranged to frictionally engage and removably secure the male profile about its rounded outer surface.

In one implementation, the rounded outer surface of the male profile has a substantially circular cross-section.

In another implementation, the rounded outer surface of the male profile has a substantially oval-shaped cross-section.

The female profile may comprise a first end proximate the base, and a second end distal from the base. The second end may include a break-away portion, in one implementation. In another implementation, the second end may include an anti-seal portion. The second end may also include a tip forming a sharp, angular profile.

The male profile and female profile may be heat-sealed to the polymeric bag. In one implementation, the male profile is heat sealed to the bag using a temperature substantially lower than that is typically employed in adhering conventional profiles to a film.

In one implementation, the break away portion is composed of material selected from the group consisting of polypropylene, nylon, and high density polyethylene.

The film attachment portion may be composed of a material such as polyethylene and EVA.

In certain implementations, the male and female profiles interlock to sealably enclose a product in the polymeric bag.

The above summary of the present invention is not intended to describe each illustrated embodiment, or every implementation, of the present invention. This is the purpose of the figures and the detailed description which follow.

BRIEF DESCRIPTION OF THE DRAWINGS

Other aspects and advantages of the invention will become apparent upon reading the following detailed description and upon reference to the drawings in which.

Figure 1:
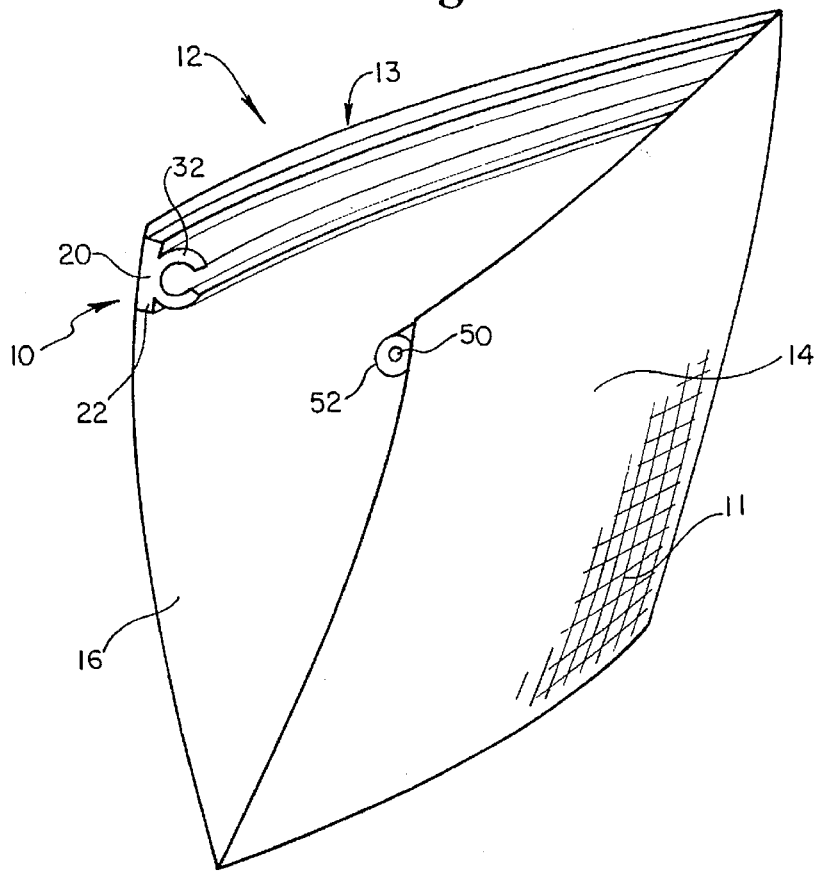
FIG. 1 is a perspective view of a reclosable bag including a reclosable zipper embodying the present invention.

While the invention is susceptible to various modifications and alternative forms, specifics thereof have been shown by way of example in the drawings and will be described in detail. It should be understood, however, that the intention is not to limit the invention to the particular embodiment described. On the contrary, the intention is to cover all modifications, equivalents, and alternatives falling within the spirit and scope of the invention as defined by the appended claims.

DESCRIPTION OF THE ILLUSTRATED EMBODIMENTS

A closure arrangement 10 for a reclosable bag 12 having a first film 14 and a second film 16 is shown in FIG. 1. Closure arrangement 10 includes a female profile 20 and a male profile 50 disposed at a mouth 13 of reclosable bag 12 and extending along the length of mouth 13. Female profile 20 and male profile 50 are disposed parallel to one another. Reclosable bag 12 may contain a product 11, such as an edible food product like cheese, luncheon meat, crackers, etc. Product 11 may be nonedible items as well, such as small hardware, toys, etc.

Figure 2:
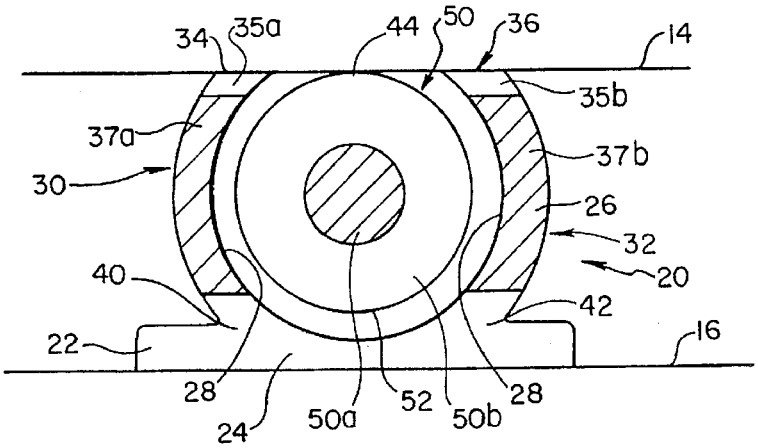
FIG. 2 is a sectional view of a first embodiment of a closure arrangement embodying the present invention, showing a break-away seal prior to being broken.
Figure 4:
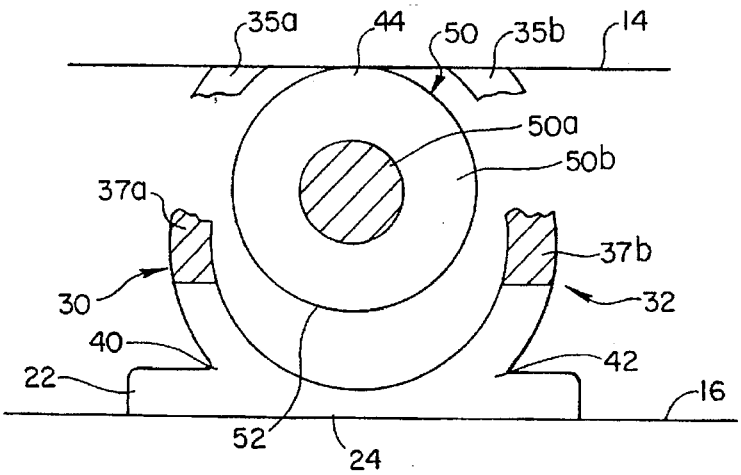
FIG. 4 is a sectional view of the closure arrangement shown in FIG. 2, showing a break-away seal after being broken.
Figure 7:
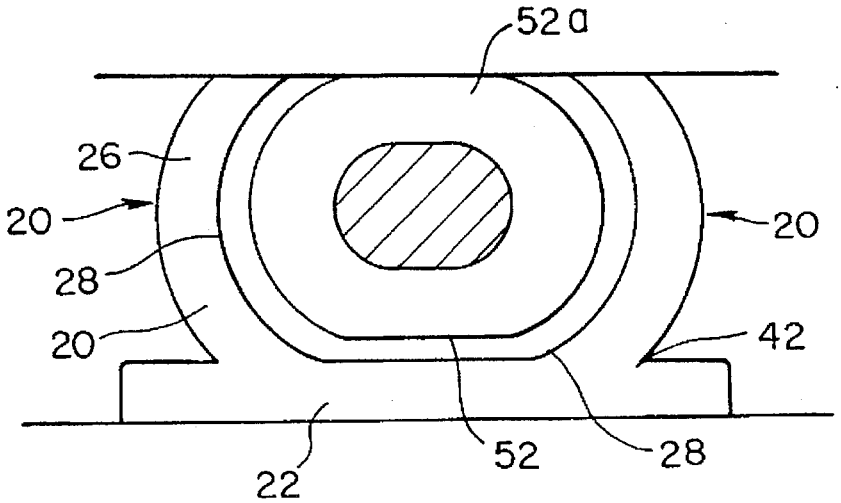
FIG. 7 is a sectional view of a closure arrangement embodying the present invention, showing an oval shaped male portion.

In a first embodiment illustrated in FIGS. 1, 2 & 4, the male profile 50 includes an outer surface 52 having a generally rounded cross section. In this embodiment, the outer surface 52 has the general cross section of an arc of a circle, while in an alternative embodiment, illustrated in FIG. 7, the outer surface **52*a*** has a generally oval-shaped cross section. Other shaped cross-sections may be used as well, so long as they provide the necessary surface area for the mating profiles.

The male profile 50 includes a film attachment portion 44 for attaching male profile 50 to first film 14 of polymeric bag 12. In one implementation, the male profile 50 is mounted directly to the first film 14. Alternatively, the male profile 50 may include a base (not shown) which is mounted to the first film 14. The male profile 50 may include a core portion **50*a* formed out of a different material than the exterior portion 50*b***.

The female profile 20 of the closure arrangement 10 includes a base 22 having a film attachment portion 24. The female profile 20 further includes a locking member 26 having a locking surface 28. The locking member 26 includes a first leg 30 and a second leg 32 which cooperate to define a portion of the locking surface 28. The locking surface 28 of the female profile 20 engages the outer surface 52 of the male profile 50. In this particular implementation, the locking surface 28 is in contact with the outer surface 52 substantially throughout its exposed portions.

The legs 30 and 32 may be of uniform cross-sectional thickness from their bases 40 and 42 to their ends 34 and 36, or may alternatively vary in thickness. The bases 40, 42 of the legs 30, 32 may be thicker than the ends 34, 36, but the bases 40, 42 should remain thin enough to permit the flexibility of legs 30, 32. The legs 30, 32 of the female profile 20 must also have sufficient rigidity to properly retain the male profile 50. Other shaped legs may be used as well, if the surface area of the contact between the profiles is increased. In that respect, sharp bends and corners should be avoided. For example, female profile 20 does not include the sharp bends of locking structures such as shoulders.

In a first embodiment, illustrated in FIG. 2, the first leg 30 and second leg 32 include outer portions **35*a* and 35*b*, respectively, formed of a thermoplastic adherable to the film 14, and intermediate break-away portions 37*a* and 37*b* formed of a break-away material. During manufacture of the reclosable bag, the outer portions 35*a* and 35*b* are thermally sealed to the first film 14 of the polymeric bag 12 to create a hermetic seal. Upon initial opening of the polymeric bag 12, the break-away portions 37*a* and 37*b* are severed from the outer portions 35*a* and 35*b* (FIG. 4**), destroying the hermetic seal but permitting access to the interior of the bag.

Figure 3:
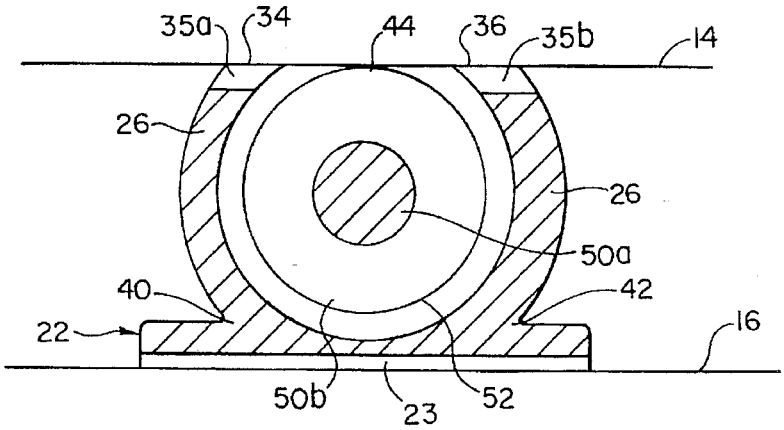
FIG. 3 is a sectional view of a second embodiment of a closure arrangement embodying the present invention, showing a break-away seal prior to being broken.

In a second embodiment, illustrated in FIG. 3, the break-away portion extends from the outer portions **35*a* and 35*b* and includes a portion of the base 22. The lower base portion 23 is constructed of a thermoplastic adhereable to the film 16**.

The break-away portions **37*a* and 37*b* (FIGS. 2 and 4) may be formed of any number of conventional and known compounds, and may be of varying thickness. In one implementation, the break-away portion is a polymeric compound, such as polypropylene, nylon, or high density polyethylene (HDPE). The outer portions 35*a* and 35*b*** may be formed of any number of conventional and known compounds, including low density polyethylene (LDPE), and may be of varying thickness. During manufacture of the closure arrangement, the various bonds or attachments between the different materials are formed such that the weakest bond is formed at the location of the break-away seals. By forming the weakest bond at the locations of the break-away seals, the application of opening forces to the closure arrangement will cause the break-away seals to rupture first. Since the other bonds are stronger than the break-away seals, these other bonds will not rupture in response to the application of opening forces.

All other bonds which are stressed while breaking the break-away seals preferably have a strength of at least about 5 pounds per lineal inch, and preferably about 6–9 pounds per lineal inch. These stressed bonds are those which involve the connection of the film attachment portion 24 of the female profile 20 and the film attachment portion 44 of the male profile 50. This difference in bond strength between the break-away seals and the aforementioned stressed bonds insures that only the break-away seals will break in response to opening the closure arrangement.

Figure 5:
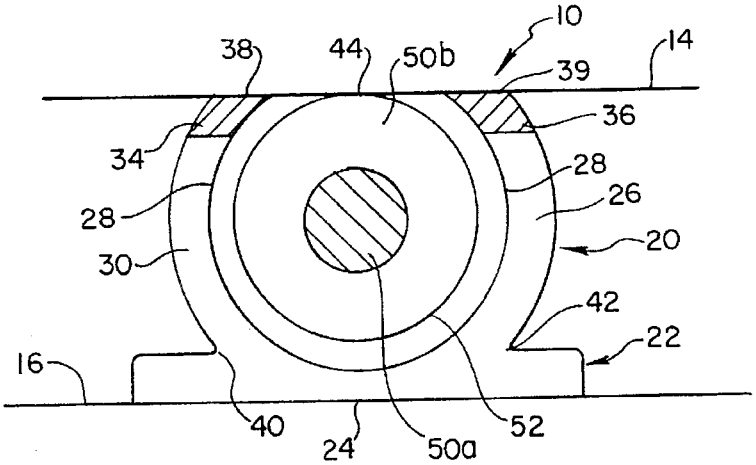
FIG. 5 is a sectional view of the closure arrangement embodying the present invention, showing anti-seal ends in contact with the top film.
Figure 6:
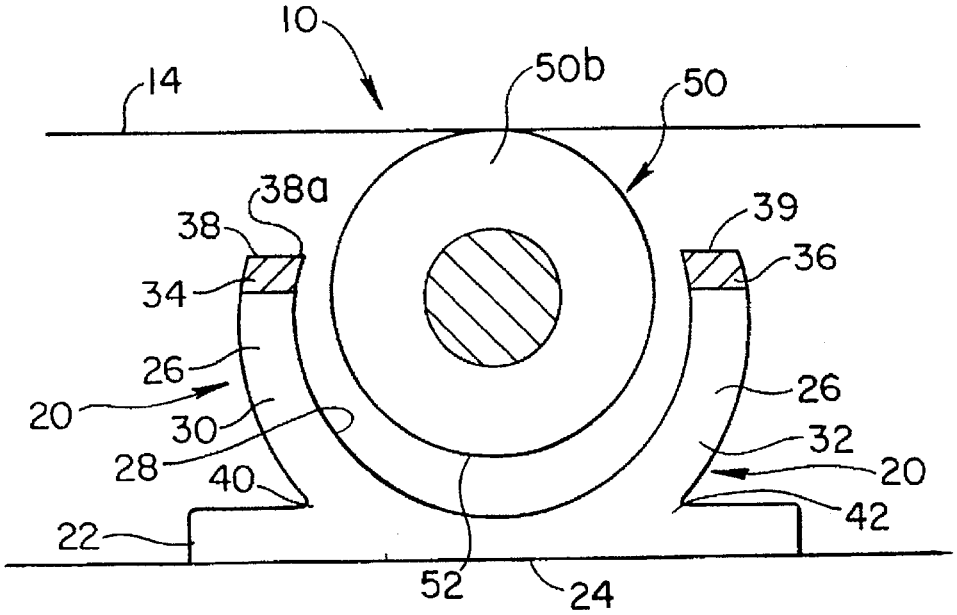
FIG. 6 is a sectional view of a closure arrangement shown in FIG. 5, showing antiseal ends withdrawn from the top film.

In a third embodiment, illustrated in FIGS. 5 and 6, the legs 30 and 32 include a first end 38 and a second end 39 composed of an anti-seal compound. The antiseal compound resists adhesion to the material forming the polymeric bag 12. In this third embodiment, the first end 38 and second end 40 do not adhere to first film 14. In this particular implementation, the inner tips 38*a*, 38*b* form a sharp, angular profile. In an alternative embodiment, the inner tips 38*a*, 38*b* have a generally rounded form. FIG. 5 illustrates the ends 38 and 39 in contact with the top film 14 but not hermetically sealed to the film 14. FIG. 6 illustrates the first ends 38 and 39 slightly removed from the top film 14.

The closure arrangement is manufactured using conventional extrusion and heat sealing techniques. In particular, the ends of the legs of the female profile 20 and the rest of the female profile are co-extruded through a die plate fed by a plurality of extruders. These extruders carry the different molten materials for forming the closure profiles. As is well known in the art, the die plate includes input ports, output ports, and channels connecting these input ports to output ports. The extruders feed the different molten materials to different input ports, and the channels are designed to configure the molten materials into the closure profiles. Because of the shape of the profiles of the present invention, the extrusion process is easier and less costly.

After extruding the closure profiles, the profiles are heat-fused to the polymeric film using heated seal bars in the positions shown in FIG. 1. Due to the shape of male profile 50, lower heat is required to seal male profile 50 to the film than in the case of conventional profiles. This is advantageous because it reduces the manufacturing cost.

After the profiles are heat sealed to the film, the film and profiles are cut into individual bags. This particular closure arrangement advantageously results in a low mass at the cut-off ends. This is advantageous because there is less waste and less chance for leakage. The resulting manufacturing cost is less expensive, and the resultant bag has an improved sealing integrity with respect to the prior art bags.

The base material used to form the base portion 22 may be composed of LDPE. The break-away material used to form the first end 34 and second end 36 of the legs 30, 32 may be composed of HDPE, polypropylene (PP), or nylon. The antiseal material used to form the non-sealing strips and the break-away portion is a heat resistant material such as polypropylene, nylon or high density polyethylene.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A closure arrangement having a female profile and a male profile for use with a polymeric bag, the arrangement comprising:

a male profile defining a rounded outer surface and having a first film attachment portion; and a female profile including:

a base having a second film attachment portion, and a first locking member having opposed surfaces constructed and arranged to engage by friction and removably secure the male profile about the rounded outer surface of the male profile, the opposed surfaces of the first locking member comprising:

a first end proximate the base; and a second end distal from the base;

wherein the second end includes a break away portion.

2. The closure arrangement according to claim 1, wherein the rounded outer surface of the male profile has a substantially circular cross-section.

3. The closure arrangement according to claim 1, wherein the rounded outer surface of the male profile has a substantially oval-shaped cross-section.

4. The closure arrangement according to claim 1, wherein the first locking member is smooth and lacks shoulders.

5. The closure arrangement according to claim 1, wherein the male profile and female profile are heat-sealed to the polymeric bag.

6. The closure arrangement of claim 1, wherein the break away portion is composed of material selected from the group consisting of polypropylene, nylon, and high density polyethylene.

7. The closure arrangement of claim 1, wherein the film attachment portion is composed of a material selected from the group consisting of polyethylene and EVA.

8. The closure arrangement of claim 1, wherein the male and female profiles interlock to sealably enclose a product in the polymeric bag.

9. The closure arrangement of claim 1, wherein the second end includes a tip forming a sharp, angular profile.

10. A closure arrangement having a female profile and a male profile for use with a polymeric bag, the arrangement comprising:

a male profile defining a rounded outer surface and having a first attachment portion attaching the male profile to film of the bag, the rounded outer surface having a substantially circular cross-section; and a female profile including:

a base having a second attachment portion attaching the female profile to film of the bag, and a pair of legs constructed and arranged to frictionally engage the male profile, each of the legs having first and second opposite ends, the first end being proximate the base, and the second end including a break-away portion for severing the second end from a portion of the leg attached to the base.

11. The closure arrangement of claim 10, wherein the male profile is heat-sealed to the bag.

12. The closure arrangement of claim 10, wherein the female profile is heat-sealed to the bag.

13. The closure arrangement of claim 12, wherein the break-away portion is composed of material selected from the group consisting of polypropylene, nylon, and high density polyethylene.

14. The closure arrangement of claim 12, wherein the first and second attachment portions are composed of a material selected from the group consisting of polyethylene and EVA.

15. The closure arrangement of claim 12, wherein each of the legs is smooth and lacks shoulders.

16. A closure arrangement having a female profile and a male profile for use with a polymeric bag, the arrangement comprising:

a male profile defining a rounded outer surface and having a first attachment portion attaching the male profile to film of the bag; and a female profile including:

a base having a second attachment portion attaching the female profile to film of the bag, and a pair of legs constructed and arranged to frictionally engage the male profile, each of the legs having first and second opposite ends, the first end being proximate the base, and the second end being treated with an anti-sealant.

17. The closure arrangement according to claim 16, wherein the rounded outer surface of the male profile has a substantially circular cross-section.

18. The closure arrangement according to claim 17, wherein the rounded outer surface of the male profile has a substantially oval-shaped cross-section.

19. The closure arrangement according to claim 18, wherein the antisealant is composed of one of the group consisting of polypropylene, nylon or high density polyethylene.

20. The closure arrangement of claim 18, wherein each of the legs is smooth and lacks shoulders.

* * * * *